United States Patent [19]

Richeson, Jr. et al.

[11] 4,109,630

[45] Aug. 29, 1978

[54] BREAKERLESS ELECTRONIC IGNITION SYSTEM

[75] Inventors: William E. Richeson, Jr., Fort Wayne; Gerald L. Kray, Butler, both of Ind.

[73] Assignee: The Magnavox Company, Fort Wayne, Ind.

[21] Appl. No.: 687,269

[22] Filed: May 17, 1976

[51] Int. Cl.[2] ..... F02P 1/00

[52] U.S. Cl. ..... 123/148 E

[58] Field of Search ..... 123/117 R, 146.5 A, 123/148 E, 148 F; 323/75 L, 75 S, 78

[56] References Cited

U.S. PATENT DOCUMENTS

| | | | |
|---|---|---|---|
| 2,700,774 | 11/1956 | Riblet | 323/75 L |
| 2,949,576 | 8/1960 | Bolton | 323/75 L |
| 3,161,803 | 12/1964 | Knittweis | 123/148 E |
| 3,241,538 | 3/1966 | Hugenholtz | 123/148 E |
| 3,361,121 | 1/1968 | Kasoma et al. | 123/148 E |
| 3,552,367 | 1/1971 | Slitti | 123/148 E |
| 3,605,714 | 9/1971 | Hardin et al. | 123/148 E |
| 3,650,260 | 3/1972 | Silvera | 123/148 E |
| 3,822,686 | 7/1974 | Gallo | 123/148 E |
| 3,923,030 | 12/1975 | Luteran | 123/148 E |

FOREIGN PATENT DOCUMENTS

| | | | |
|---|---|---|---|
| 2,328,305 | 1/1975 | Fed. Rep. of Germany | 123/146.5 A |
| 2,325,230 | 12/1974 | Fed. Rep. of Germany | 123/148 E |
| 2,326,257 | 12/1974 | Fed. Rep. of Germany | 323/75 L |
| 2,410,454 | 9/1975 | Fed. Rep. of Germany | 123/148 E |
| 191,900 | 3/1967 | U.S.S.R. | 323/75 L |

*Primary Examiner*—Charles J. Myhre
*Assistant Examiner*—R. A. Nelli
*Attorney, Agent, or Firm*—Thomas A. Briody; Frank R. Trifari; William J. Iseman

[57] ABSTRACT

An electronic ignition system for an internal combustion engine having a timing signal source comprising an oscillator for providing a carrier signal; an electronic network connected to the oscillator and including a sensor means for providing a reactance which varies as a function of the rotational position of the engine, the network further including a reference means for comparing the reactance of the sensor means and providing modulation of said carrier signal; a detector for demodulating the modulated carrier signal and providing an output signal indicative of a predetermined rotational position of the engine. The output signal is supplied to switching circuitry for switching the primary of an ignition coil and providing a high voltage output pulse at a time synchronized with said predetermined rotational position of the engine.

5 Claims, 21 Drawing Figures

TYPICAL
TYNE WIDTH
XL2
XL1
TYNE TRAVEL
Δφ

+
0

+
0

TYPICAL TYNE WIDTH
XL2
XL1
TYNE TRAVEL

Δφ=0
Δφ

Δφ

BREAKERLESS ELECTRONIC IGNITION SYSTEM

This invention relates to a breakerless electronic ignition system and more particularly to an ignition system employing an improved timing signal source for controlling the spark or fuel injection timing of an internal combustion engine.

It is well known that the spark ignition timing of an internal combustion engine is a very important factor with regard to engine performance, efficiency, operational economy and pollution content of the exhaust gases of the engine. Because of the ever increasing stringency of pollution control requirements as well as the increasing necessity for economical engine operation and the resultant conservation of fuel, it is important that the ignition system be capable of providing long periods of proper adjustment and trouble free operation. Proper breaker point adjustment and ignition timing are of prime importance.

Prior art mechanical breaker ignition systems, as are well known, inherently require very frequent adjustments to maintain their initial performance characteristics. These mechanical systems although not capable of providing the currently desirable and required characteristics were previously considered adequate because of the much lesser degree of importance placed on both fuel economy and pollution control. Mechanical breaker ignition systems have inherent factors affecting their performance. In these mechanical systems, breaker contact wear, contact erosion, and susceptibility of the contacts to contamination cause undesired changes in not only the electrical conductivity and shape of the contacts but also result in changes in the gap or spacing of the contacts and thus affect ignition timing adjustments. In addition, wear of the distributor cam, the rubbing block as well as wear on the distributor shaft bearings result in variations in the change of the breaker gap spacing and timing adjustments all of which can combine and result in highly unpredictable and undesirable changes in the ignition system operating characteristics. These prior art mechanical breaker systems are also susceptible to changes in engine speed. At high engine speeds, the breaker contacts, or points as they are often referred to, tend to bounce and float causing unpredictable changes in ignition timing. This latter problem is difficult to overcome in mechanical breaker systems because the inherent mass of the movable breaker contact arm assembly and the spring loading of the arm will not permit the contacts to open and close precisely in synchronization with the distributor cam lobes as the engine speed is increased even to moderate speeds.

Breakerless ignition systems are gradually replacing mechanical systems because many of the undesired characteristics of the mechanical system are overcome by replacing the mechanically activated contacts with non-mechanical sensors. Many such breakerless systems using various types of sensors and associated electronic circuitry have been proposed; however, not all have been entirely satisfactory. Many such breakerless systems, while overcoming some of the mechanical system problems, have created new and undesirable characteristics not previously present with the mechanical breaker ignition systems.

Prior art breakerless ignition systems combat many of the weaknesses of aforementioned mechanical breaker systems by replacing the mechanically activated breaker contacts or points with various types of electrical and electro-optic sensors and associated electronic circuitry which, in effect, sense the rotational position of the engine. In such breakerless systems, signals are provided to activate electronic circuitry for either switching or driving the primary of the ignition coil as is well known.

Sensors suitable for use in breakerless ignition systems can be categorized in one of two general operational areas. In the first category are those sensors which operate as electric signal generators. Such sensors provide an electrical output signal as a direct function of the rotational position of the engine. The well known magnetoelectric, photo-electric, piezo-electric, and Hall effect type transducers can be used as sensors of the first category. Examples of prior art ignition systems using magneto-electric and photo-electric type sensors are shown in the respective U.S. Pat. Nos. 3,087,001 to Short et, al. and 3,613,654 to Gilbert.

In the second category are those sensors which operate to provide some change of sensor characteristic or parameter as a function of the rotational position of the engine. Systems using these sensors require additional means responsive to the change for providing a usable electric output signal. Examples of prior art ignition systems in this second category where changes in capacity, mutual inductance, and circuit "Q" or loading is used are shown in the respective U.S. Pat. Nos. 3,650,260 to Silvera; 3,361,123 to Kasama et al.; 3,822,686 to Gallo; and 3,605,714 to Hardin et al.

A high signal to noise ratio is desired in any type ignition system to provide reliable operation and reduce the systems susceptibility to external noise and spurious signal pickup. In magneto-electric type sensors, this not only requires critically small air gaps, but also requires strong magnetic fields and large inductances which generally requires relatively large physical packaging of this type of sensor. Another disadvantage of the magneto-electric sensor is the fact that its output signal level is a direct function of engine speed and therefore at low cranking speeds the output level is also low. During engine cranking, a high output level is usually desired.

A piezo-electric sensor although relatively reliable is somewhat fragile. This type sensor is also susceptible to vibration. Another disadvantage of a piezo-electric type sensor is the difficulty in providing an efficient mechanical coupling between the piezo-electric element and a rotational portion of the engine without involving excessive mass which can cause timing inaccuracies as in mechanical breaker systems.

Use of the type of sensor which for example, operates to provide a change of circuit "Q" or loading or a sensor which provides a change of mutual inductance generally requires high frequency operation of the circuitry which is responsive to the changed characteristic. As an example, the "Q" or loading change when used with an oscillator to provide control between an oscillating state and a non-oscillating state typically oscillates at a frequency of between 300 and 400 KHz. A mutual inductance change is typically used as a conventional transformer supplying a signal from a primary winding to a secondary winding in, for example, a feedback network of an oscillator. A high operating frequency is desirable for this type use, to improve the coupling efficiency between the windings as well as provide a greater percentage of mutual inductance change. It is also desirable to have a high "Q" circuit. The use, however, of relatively high operating frequencies and high "Q" circuits in inherently unstable circuits such as the oscillatory circuits described, is undesirable since circuit performance degradation is much more likely to occur with environmental changes such as temperature and humidity as well as with changes in circuit component values and operating parameters which normally change over a period of time.

The use of the sensors, mentioned in the previous paragraph, in ignition systems wherein the sensor parameter controls the operation of an oscillator between an oscillating state and a low level or non-oscillating state for providing a timing signal, can also result in timing errors as engine speed is varied. These errors are not only undesirable but are in some instances unpredictable which increases the difficulty in providing for their compensation. In such ignition systems, the errors are primarily due to an inability of oscillatory circuits to react synchronously with rapid changes in "Q", tuned circuit loading, or oscillator loop gain functions as may be provided by the sensor. The rise and decay times of the oscillator output signal vary as a function of circuit "Q", frequency of operation of the oscillator, as well as the rate at which the oscillator is caused to change states. Thus in such type ignition systems, the resultant timing signals do not always occur precisely at the desired times or rotational positions of the engine as the engine speed is varied. Typically, the timing signal is caused to be retarded as the engine speed is increased.

In view of the foregoing, it is an object of the present invention to provide an improved breakerless ignition system for use with an internal combustion engine.

It is an object of the present invention to provide a breakerless ignition system having improved immunity to environmental changes and externally generated electrical interference.

It is another object of the present invention to provide a timing signal source including a sensor and a reference element and having a network means for comparing an electrical characteristic or property of the sensor with that of the reference element for generating a timing signal indicative of a rotational position of the engine.

It is another object of the present invention to provide a timing signal source for internal combustion engines having a variable reactance sensor and a predetermined reference reactance in a bridge network for modulating a carrier signal and having a demodulator for demodulating the modulated carrier signal and providing an ignition timing signal indicative of one or more predetermined rotation positions of the engine.

It is yet another object of the present invention to provide a timing signal source for internal combustion engines having a carrier signal source for generating a carrier signal and having a modulation means including a position sensor element and a position reference element for amplitude modulating the carrier signal in accordance with one or more predetermined rotational positions of the engine and having a means for demodulating the amplitude modulated carrier signal and providing an ignition timing signal indicative of one or more of the rotational positions of the engine.

It is still another object of the present invention to provide a timing signal source for internal combustion engines having a carrier signal source for generating a carrier signal and having a modulation means including a position sensor element and a position reference element for phase modulating the carrier signal in accordance with one or more predetermined rotational positions of the engine and having a means for demodulating the phase modulated carrier signal and providing an ignition timing signal indicative of one or more of the rotational positions of the engine.

It is yet another object of the invention to provide improved breakerless ignition system having a timing signal source which is well adapted to implementation using low cost, reliable, and readily available integrated circuits.

SUMMARY OF THE INVENTION

In accordance with the present invention in one embodiment, there is provided a breakerless ignition system for internal combustion engines or the like having a sensor means for providing an inductance which varies as a function of rotational position of the engine and having a reference inductor. The inductance of the sensor means is continuously compared with the inductance of the reference inductor in a bridge comparison network. The reference inductor having a predetermined inductance value corresponding with or bearing a predetermined relationship to one or more predetermined rotational positions of the engine at which ignition is desired. A carrier signal is supplied to the bridge network from a carrier signal source coupled to the network. The bridge network operates to provide amplitude modulation of the carrier signal in accordance with the one or more rotational positions of the engine. The modulated carrier signal from the bridge network is supplied to a demodulator which provides a demodulated and filtered output signal comprising a train of pulses occurring in time synchronism with the predetermined rotational positions of the engine and having pulse widths representing a dwell angle. The output signal from the demodulator is coupled to a power switching means which operates to supply a switching or drive voltage to the primary winding of a high voltage ignition coil for providing spark ignition voltage to one or more spark plugs for operation of the engine.

In another embodiment of the invention, the bridge network provides a phase modulated output signal which is in turn demodulated by a phase demodulator.

In still another embodiment of the invention, a low cost and readily available operational amplifier in an integrated circuit form is provided for detecting and processing the phase modulated signal.

It will be noted that although the present invention is described in relation to an ignition system for an internal combustion engine, the invention also has application for use as a tachometer or for determining rotational position of an object. The detected or demodulated output signal indicates rotational position of an object or can be counted with respect to time and used as a tachometer reading instead of being used as a signal to initiate a high voltage pulse to a spark plug.

The subject matter which we regard as our invention is set forth in the appended claims. The invention itself, however, together with further objects and advantages thereof, may be better understood by referring to the following detailed description taken in conjunction with the accompanying drawings.

The exemplifications set out herein illustrate the preferred embodiments of the invention in one form thereof, and such exemplifications are not to be construed as limiting in any manner.

DETAILED DESCRIPTION OF THE PREFERRED EMBODIMENTS

Figure 1:
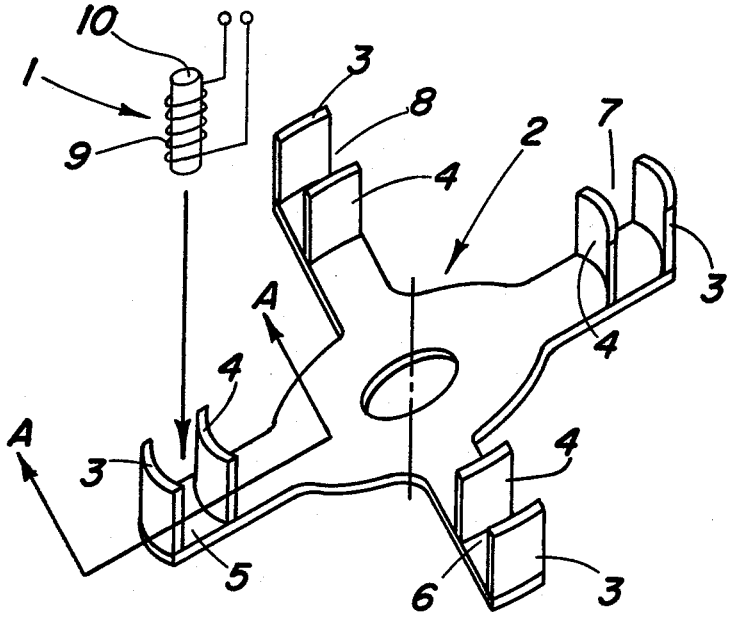
FIGS. 1 through 6 show various arrangements of the sensor inductor and rotating tynes in accordance with the invention.
Figure 2:
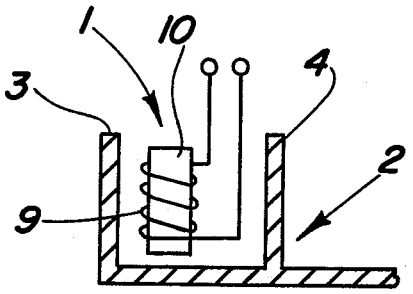
Figure 3:
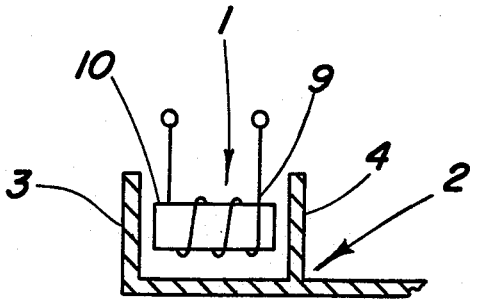
Figure 4:
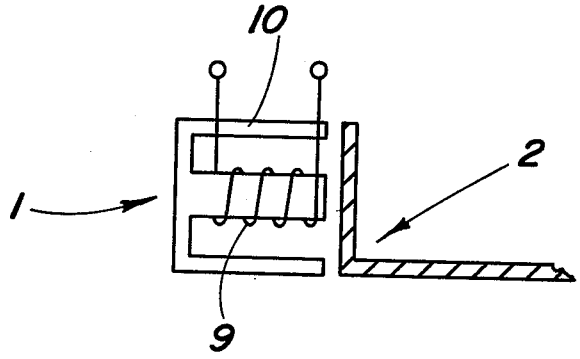

Referring first to FIG. 1, there is shown a sensor inductor 1 and tyne assembly 2 for use in a breakerless ignition system in accordance with the present invention. The sensor inductor 1 and tyne assembly 2 can be contained within a distributor housing, if desired. The tyne assembly 2 is mounted to rotate with the distributor shaft so as to provide synchronous rotation with the engine. The sensor inductor 1 is mounted in a substantially fixed position with respect to the rotating tyne assembly 2. The sensor inductor 1 is mounted radially and coaxially outward from the center of the tyne assembly 2 as shown in FIG. 2 which is a partial cross section of the view A—A shown in FIG. 1. In the arrangement shown in FIGS. 1 and 2, the sensor inductor 1 is positional between the rotating tynes such as tynes 3 and 4 of the tyne pair 5 whereby rotation of the tyne assembly 2 will cause each one of the separate tyne pairs 5 to 8 to successively approach, enclose, and leave the sensor inductor 1. The tyne assembly 2 is positioned on the distributor shaft so that at a given predetermined position of the inductor 1 relative to each one of the tyne pairs 5 and 8, there is provided ignition spark as will hereinafter be apparent. The relationship between the sensor inductor 1 and the rotating tyne assembly 2 is much the same as that which exists between the cam and breaker contact assembly in a conventional mechanical breaker ignition system. The mounting of the sensor inductor 1 can also provide for incremental movements of the sensor inductor 1 relative to the tyne assembly 2 as a function of one or more operating conditions of the engine much the same as the distributor vacuum advance mechanism of the convention ignition system.

The sensor inductor 1 preferably comprises an inductance coil 9 and core 10 although in some embodiments the core 10 need not be used. As each one of the tyne pairs 5, 6, 7 and 8 of the rotating tyne assembly 2 approach, enclose, and leave the sensor inductor 1, there is provided a change of reactance of the sensor inductor 1. This change of reactance can, for example, be provided by an induced shorted turn effect if the tyne material is conductive and/or can be provided by a magnetic permeability change if the tyne material has magnetic properties. The inductance, reactance, and impedance of the sensor 1 are considered as interacting characteristics with a change in one, normally affecting a change in the others. Although all reference herein to a change in the reactance of the sensor 1 is also to be considered to include a change in its impedance, it will be apparent that such an impedance change can result from a change in the reactance and/or a change in the effective resistance of the sensor 1. The material which is used for the tynes of tyne assembly 2 can accentuate either a change in the reactance or the effective resistance of the sensor 1. To exemplify, an electrically conductive and nonmagnetic tyne material such as brass or aluminum can be used to accentuate eddy current losses thereby causing an accentuated change in the effective resistance of the sensor 1 with, of course, a change in the sensor impedance. On the other hand, a non-conductive, magnetic tyne material such as ferrite can be used to accentuate a change in the sensor 1 reactance with a minimal change in the effective resistance of the sensor. Likewise, a conductive, magnetic material such as stamped or cast iron can result in a change in both the effective resistance as well as the reactance of the sensor 1. The use of any of these types of tyne material will, however, for all practical purposes result in a change in sensor reactance and although any one of the above described tyne materials can be used, some will be more suitable than others from the standpoint of both cost and operational effectiveness. It will be later apparent, that the tyne material used in any particular modulation embodiment of the herein disclosed invention is chosen to provide an engine position information signal having a maximum degree of modulation resulting from the influence of the tynes upon the sensor. The tyne material of all of the tyne pairs 5 to 8 of, for example, the tyne assembly 2 of FIG. 1 is normally of one type; however, it need not be. Although the tyne assembly 2 shown in FIG. 1 has 4 tyne pairs 5 to 8, a greater or lesser number can be used. The 4 tyne assembly of FIG. 1 can, for example, be used in a 4 cylinder engine where it is desired to successively spark each one of the 4 cylinders separately or it can be used in an 8 cylinder engine where pairs of cylinders are sparked simultaneously.

Figure 5:
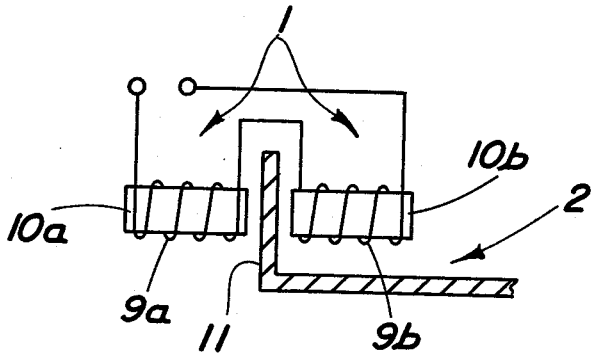
Figure 6:
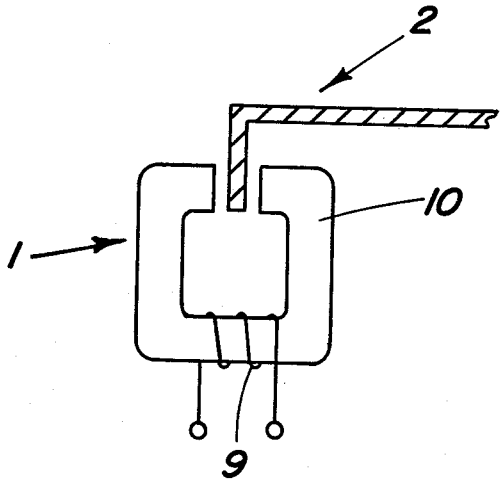

Alternate sensor inductor and tyne configurations are illustrated in FIGS. 3-6. The arrangement shown in FIG. 3, as in FIG. 2, is suited to provide a reactance change due to either the aforementioned shorted turn effect or change in permeability whereas the configurations shown in FIGS. 4 and 6 were found to be best suited to provide permeability changes. The configuration shown in FIG. 5 provides a change in the mutual inductance between the two series connected sensor coils 9*a* and 9*b*. In this configuration, the tyne 11 operates to act as a magnetic shutter or shield between the coils 9*a* and 9*b* thereby effecting a change in the mutual coupling between the coils.

It will be understood that the tyne assembly can be a solid piece of material with built-up areas or knobs extending a slight distance from the solid body. The knobs would then provide a reactance change as they pass adjacent the sensor inductor. Alternatively, the tyne assembly can be an essentially solid or continuous tyne and have a slight indentation or gap (a void of material). Then the void of material would provide the reactance change as the void passes adjacent the sensor inductor.

Figure 7:
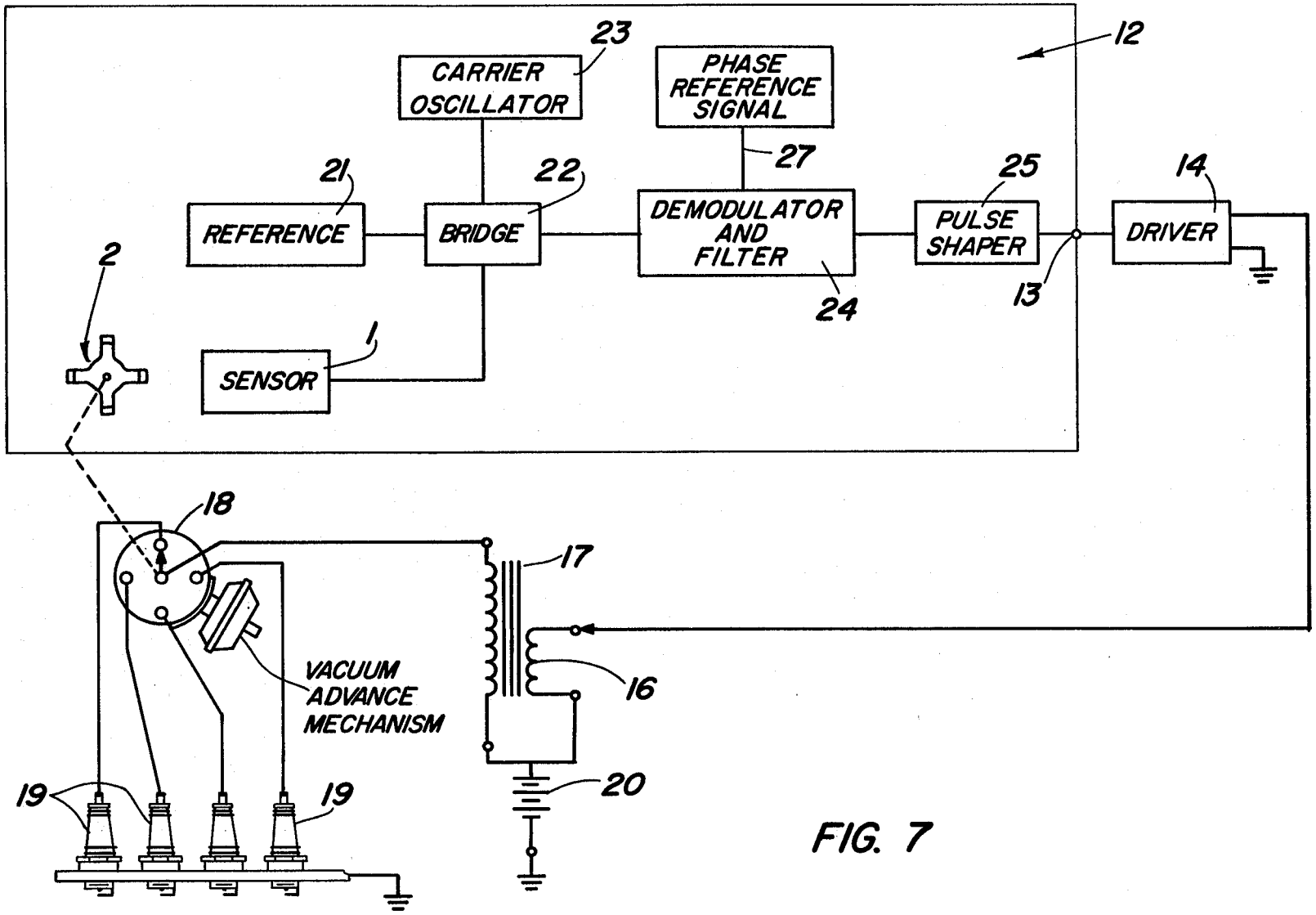
FIG. 7 shows a simplified block diagram of an improved breakerless ignition system in accordance with the invention.

Referring now to FIG. 7 there is shown a breakerless ignition system in accordance with the present invention and using any desired one of the sensor inductor 1 and tyne assembly 2 configurations illustrated in FIGS. 1–6. A timing signal source 12 operates upon the reactance change of the sensor inductor 1 and in response thereto, provides an output signal at output terminal 13. The output signal from the timing signal source 12 is supplied to a spark coil driver 14. The driver 14 operates to provide switching of the primary winding 16 of the high voltage (H.V.) spark coil 17. The spark coil 17 and a H.V. distributor 18 operate in the conventional well known manner to provide sparking or firing of the spark plugs 19. The driver 14 can be any well known switching circuit, preferably of solid state design, operating to provide switching of the primary winding 16 in series with the battery source 20 as shown in FIG. 7. In this manner of operation, the driver 14 replaces the conventional breaker contacts in the primary of the H.V. spark coil 17. The driver 14 can also operate to provide a voltage or current drive pulse to the primary winding 16 of the spark coil 17 in which case the battery 20 is not required. It will be apparent to those skilled in the art that the timing signal source 12 can also be used in combination with other types of H.V. ignition spark generating circuits such as the well known capacitive discharge type.

It should be understood that the revolving tyne assembly 2 and associated tynes provide a reactance change in the sensor inductor 1 at times of engine rotation when sparking at one or more of the spark plugs 19 is desired. The reactance of the sensor inductor 1 is compared against a reference inductor 21 in a bridge 22. A signal source input to the bridge is provided by the carrier oscillator 23. As will later be apparent, the reactance of the reference inductor 21 can be of a predetermined value to provide a balance and/or an unbalance condition at any desired positional relationship between the sensor inductor 1 and each one of the tynes of the tyne assembly 2. The output signal from the bridge 22 being a function of the relative position of the one or more tynes and the sensor inductor 1. The reference inductor 21 is preferably located physically near the sensor inductor 1 to minimize effects of surrounding environmental and electro-magnetic interference conditions. The output signal of the bridge 22 is detected and filtered by the demodulator 24. The output signal from the demodulator 24 is normally a D.C. pulse having leading and trailing edges related to the desired times of sparking and having a pulse width normally equal to the desired dwell time. A Schmidt trigger or pulse shaping circuit 25 is supplied by the output of the demodulator 24 to steepen the leading and trailing edges of the demodulator output pulse signal, although in some instances this pulse shaping may not be necessary. A Schmidt trigger type of pulse shaper 25 is referenced in the description of the invention embodiments, however, any one of other well known shaping circuits such as over driven or saturated amplifiers are equally suitable. The bridge circuit 22 in effect, operates to modulate the output signal from the carrier oscillator 23. In one embodiment of the invention, the demodulator 24 operates to detect an amplitude modulated output signal from the bridge 22; in another embodiment the demodulator 24 operates as a phase detector for detecting a phase modulated output signal from the bridge 22. In the latter embodiment, a phase reference signal from a phase reference signal source is supplied to the demodulator 24 by the signal line 27. In one later described embodiment the phase reference signal is provided by the bridge 22 although it can be provided by the carrier oscillator 23. The component values of the bridge circuit 22 can be made to accentuate either amplitude or phase modulation of the bridge output signal as a function of the effect of the tynes of the tyne assembly 2 upon the sensor inductor 1. In addition, the tyne material can be selected to accentuate either an amplitude or phase change. For example, it was found that conductive iron tynes created larger phase differentials, thus such tyne material is preferable for phase modulation systems as will later be described in more detail.

It should be understood that the term modulation, as used herein, includes a process of operating upon a single signal for providing or generating an information bearing signal or signals, the information being related to the rotational position of the engine. The above definition includes, but is not to be limited to, the classic definition of modulation namely, to vary the amplitude, frequency, or phase of a electric wave by impressing one wave on another wave of constant properties.

Figure 8:
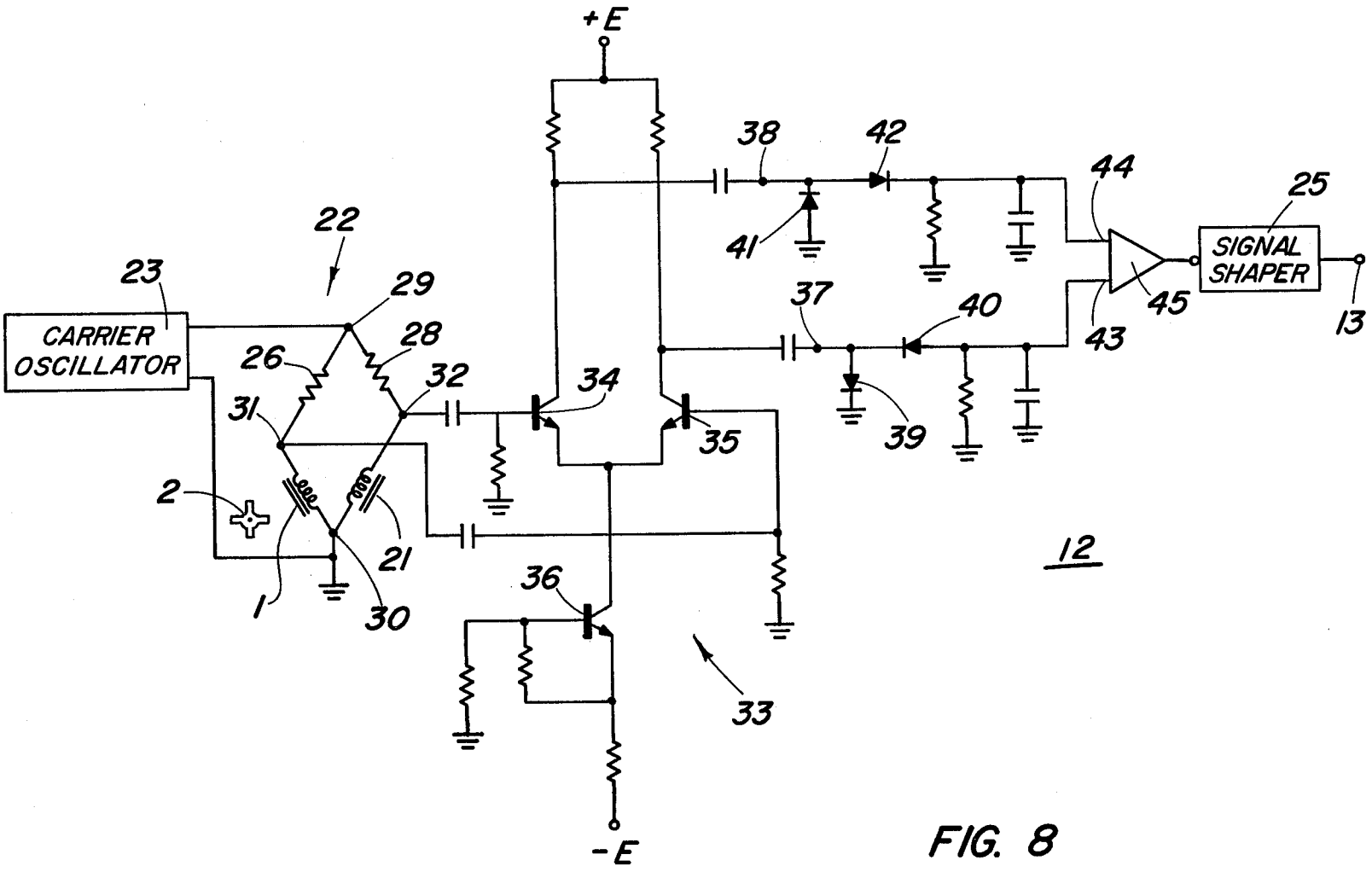
FIG. 8 shows a diagram of one embodiment of a timing signal source in accordance with the invention suitable for use in the system of FIG. 7.

FIG. 8 shows a more detailed diagram of the timing signal source 12 suitable for use in the breakerless ignition system of FIG. 7. The timing signal source 12 shown by FIG. 8 provides amplitude modulation and demodulation of the carrier. The output signal of the carrier oscillator 23, which in one embodiment provides a 700 KHz sine wave output signal, is supplied across the bridge signal input terminals 29, 30. The output signal from the bridge 22 appears at the output terminals 31, 32. The resistor 26 and sensor inductor 1 comprise one arm of the bridge 22 while the second arm is comprised of resistor 28 and the reference inductor 21. Other bridge or modulator arrangements are of course possible without departing from the spirit of the invention. In one embodiment such as shown in FIG. 8, the reactances of the reference inductor 21 and the sensor inductor 1 and the resistances of the resistors 26, 28, are such that the bridge 22 is balanced when the sensor inductor 1 is removed from proximity of the tynes of the tyne assembly 2 and conversely unbalanced when the sensor inductor 1 is fully acted upon by the tynes of the tyne assembly 2. This latter unbalanced condition would, for example, occur when the sensor 1 is totally enclosed by the tynes 3 and 4 of tyne pair 5 when the tyne assembly 2 configuration of FIG. 1 is used. The operation of bridge circuits such as bridge 22 under balance and unbalanced conditions is well known and is not therefore described in detail herein.

Figures 9A, 9B, 9C, 9D, 9E:
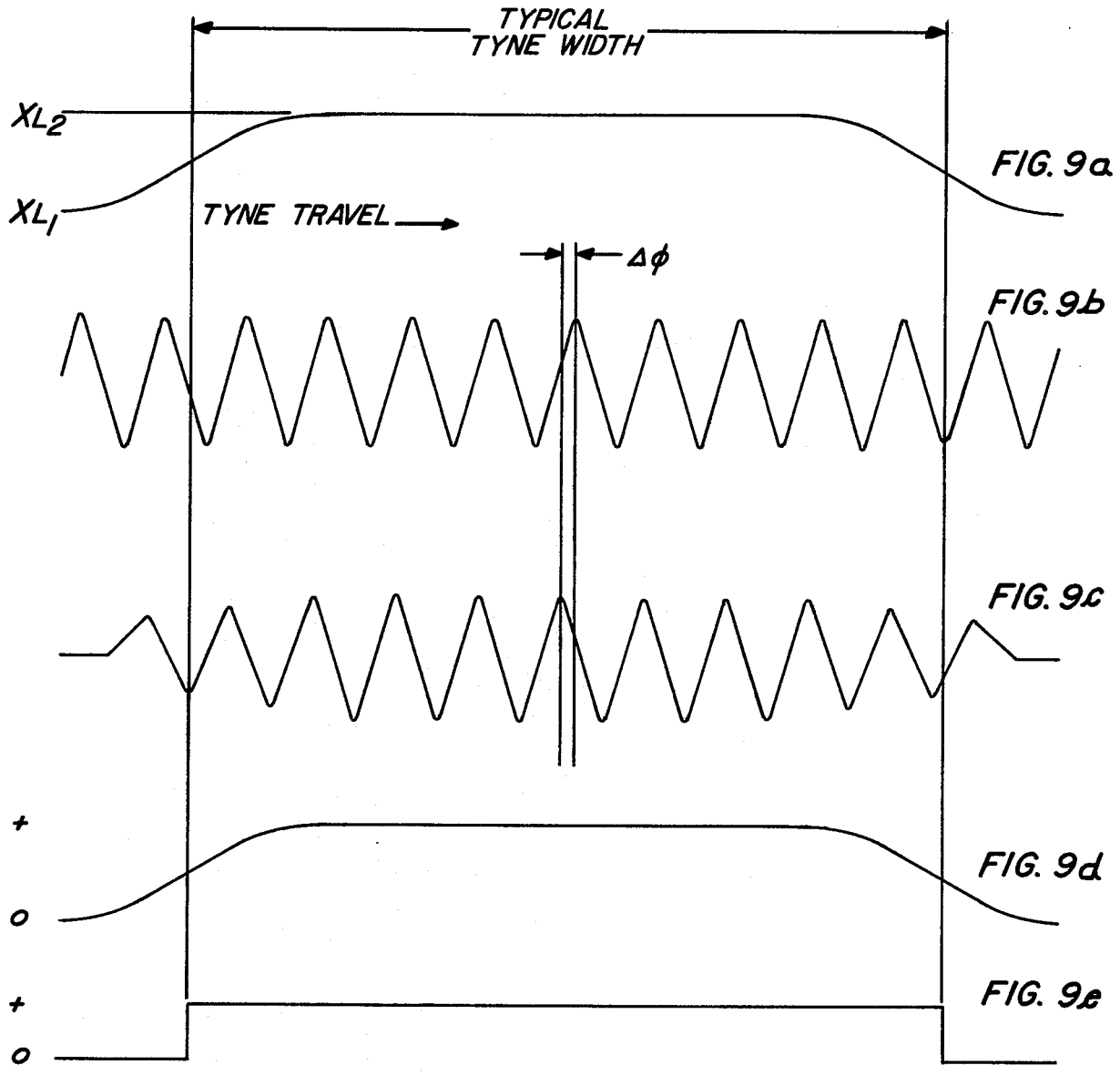
FIGS. 9*a* through 9*e* show the relationship of various signal waveforms in the timing signal source of FIG. 8 adjusted for one possible type of operation.

FIGS. **9*a* through 9*e* show various operating waveforms useful in the understanding of the invention and in particular with reference to FIG. 8. FIG. 9*a* shows a plot of the change of inductive reactance of the sensor inductor 1 as it approaches, is enclosed by, and leaves the tynes of, for example the tyne assembly 2 of FIG. 1. The physical width of the tyne is preferably larger than the effective width of the sensor inductor 1 and is typically on the order of 10 to 1. In other words, if the tyne width is 0.5 inch, the effective width of the sensor inductor 1 would be approximately 0.05 inch. The carrier signal from carrier oscillator 23 supplied to carrier signal input terminals 29, 30 of the bridge 22 is shown by FIG. 9*b*. The signal output from the bridge 22 and appearing across output terminals 31, 32 is represented by FIG. 9*c*. This waveform shown by FIG. 9*c* is in effect, the signal output from the carrier oscillator 23 and shown by FIG. 9***b* after being amplitude modulated by the bridge 22 as a function of the relative position of the sensor inductor 1 and tynes of the tyne assembly 2. The leading and trailing edges of the waveforms shown in FIG. 9 (as well as those shown in FIG. 11 and described herein later) are in the actual operating embodiments, much steeper than shown in the Figures; likewise the frequency of the signal output from the carrier oscillator 23 and shown in the above referenced waveform figures is much higher than shown. As a typical example, at a distributor shaft rotational speed of 2,000 rpm, a 25° dwell time such as can be represented by the tyne width shown by FIG. 9*a* would encompass approximately 1500 cycles of a 700 KHz carrier signal represented by FIG. 9*b*. Therefore, steepness of the waveform edges as well as the carrier signal frequency are as is illustrated in the figures simply for ease of explaining the operation of the system.

The signal output from the bridge or modulator 22 is shown by FIG. 9*c* as an amplitude modulated waveform although it is apparent that some phase shift also occurs in the modulated waveform. The phase shift is identified as $\Delta\phi$ in FIG. 9*b* and occurs as a result of the difference of the impedance of the bridge arm comprised of the resistor 26 and the inductive reactance $X_L$ of the sensor 1 and the impedance of the bridge arm comprised of the resistor 28 and the inductive reactance of the reference inductor 21.

The amplitude modulated signal output from the bridge 22 of FIG. 8 and appearing across the sensor inductor 1 and the reference inductor 21 and existing between the respective output terminals 31, 32 and ground are supplied to the input of a balanced output, differential amplifier 33 comprised of transistors 34, 35, 36 and associated circuitry which is well known in the art. The differential amplifier in the FIG. 8 embodiment operates to amplify the aforementioned signals appearing across the sensor inductor 1 and the reference inductor 21 and provides the amplified signals at the respective signal output terminals 37, 38, and ground. Thus the waveform shown by FIG. 9*c* also represents the amplitude modulated signal appearing between the output terminals 37, 38. The output signals at terminals 37, 38 are in turn supplied to respective amplitude detectors comprised of diodes 39, 40 and 41, 42. The unlabeled resistors and capacitors shown in the FIG. 8 diagram and associated with the respective diode detectors comprise conventional detector load and filter circuits. The detector output signals are in turn supplied to the respective input terminals 43, 44 of a differential amplifier 45. The output of the differential amplifier 45, shown by FIG. 9*d*, is thus the detected envelope of the waveform shown in FIG. 9*c*. The output of the differential amplifier 45 is supplied to the Schmidt trigger 25 which operates to trigger on the leading and trailing edges of the detected envelope waveform of FIG. 9*d*. The output of the Schmidt trigger 25 is shown by FIG. 9*e*. The output waveform of FIG. 9*e* is used as previously described with relation to the operation of the ignition system of FIG. 7, to switch the primary of the H.V. spark coil 17 and provide sparking at a time corresponding to the change of level of the waveform shown by FIG. 9*e*. The timing signal source 12 illustrated in FIG. 8 thus operates as an amplitude modulated system. The reactance $X_{L_2}$ of the sensor inductor 1 shown by FIG. 9*a* in the above described operation of FIG. 8 represents the reactance of the sensor inductor 1 when the tynes 3, 4 of FIG. 1 enclose the sensor under which condition the bridge 22 is unbalanced. It will now be apparent that changes in operation can be made for other conditions of balance.

It will be noted that the balanced output differential amplifier 33 shown in FIG. 8 can be replaced by two separate conventional amplifiers. In such case, the signal appearing at bridge terminal 31 would be amplified by the first of the separate amplifiers, while that signal appearing at terminal 32 would be amplified by the second separate amplifier. An amplitude detector circuit as is well known in the art, can also be connected directly across the bridge output terminals 31 and 32 for demodulating the modulated carrier signal appearing at bridge terminals 31, 32 and providing an output timing signal which can be amplified and shaped as desired. It is preferred that any circuitry connected to the bridge output terminals 31, 32 have a relatively high input impedance to prevent any undesired shunting of the bridge circuit 22.

Figure 10:
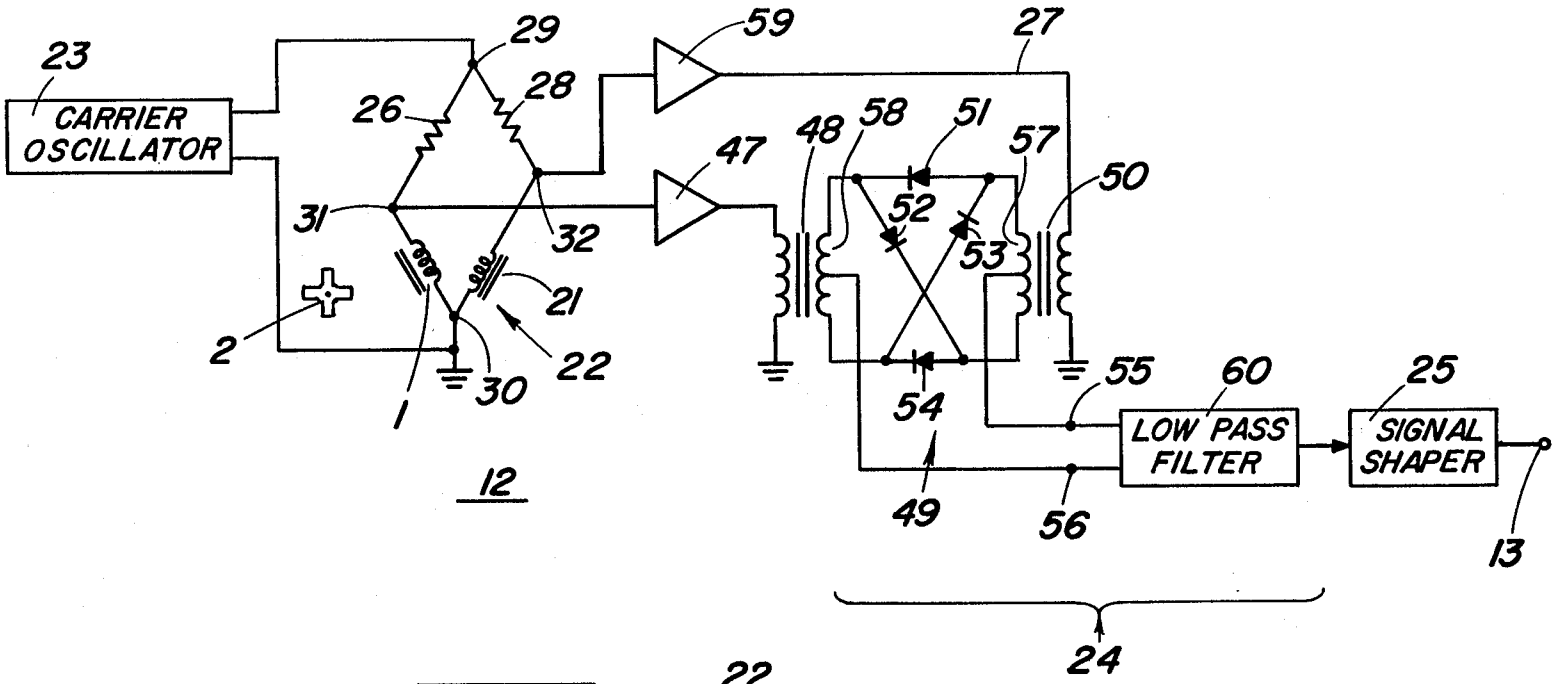
FIG. 10 shows a diagram of another embodiment of a timing signal source in accordance with the invention suitable for use in the system of FIG. 7.
Figures 11A, 11B, 11C, 11D, 11E:
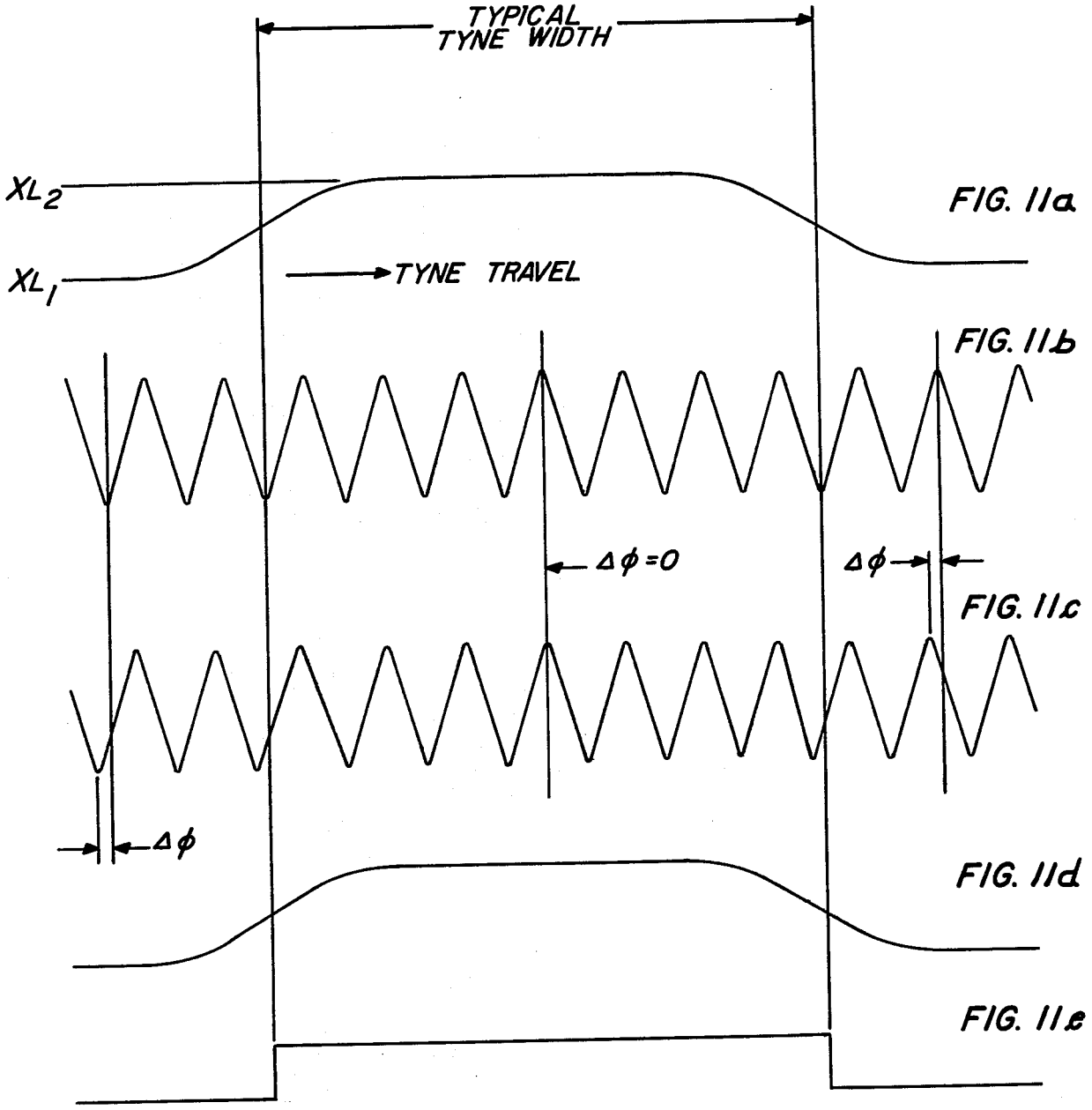
FIGS. 11*a* through 11*e* show the relationship of various signal waveforms in the timing signal source of FIG. 10 adjusted for one possible type of operation.

Now referring to FIG. 10, there is shown a simplified diagram of a timing signal source 12 which operates to provide phase demodulation of a phase modulated output signal from the bridge 22. The waveforms shown by FIGS. 11*a* through 11*e* are referred to in the following description of operation of the timing signal source 12, shown in FIG. 10, in accordance with the immediate invention. The carrier signal output from the carrier source 23 is supplied to the input terminals 29, 30 of the bridge 22. The output signal from the bridge 22 appears at the bridge output terminals 31, 32. The voltage which appears across the sensor inductor 1 between the output terminal 31 and ground and the voltage appearing across the reference inductor 21 between output terminal 32 and ground may or may not be in phase with each other depending upon the impedance of each one of the respective arms of the bridge comprised of resistor 26, sensor inductor 1 and resistor 28, reference inductor 21. As an example, when the resistors 26, 28 are made equal in value and the reactance of both the sensor inductor 1 and the reference inductor 21 are of equal value, the output voltage across both the sensor and reference inductors will be in phase. This, of course, assumes that the internal resistance of both inductors are identical or practically so. In the FIG. 10 embodiment, the reference inductor 21 is of a fixed and predetermined inductive value so that variation of the inductance of the sensor resulting from the effect of the passing tynes of the tyne assembly 2 upon the sensor inductor 1, will provide the two aforementioned signal output voltages from the bridge 22 to vary in phase with respect to each other. For purposes of explanation, the bridge 22 of the FIG. 10 embodiment is adjusted for operation to provide the output voltages appearing across the sensor inductor 1 and the reference inductor 21 to be in phase with each other when the sensor inductor 1 is for example, fully enclosed by the tynes 3, 4 of the tyne assembly 2 and out of phase when the sensor inductor 1 is, for example, midway between tynes. This operating condition is shown by FIGS. 11*a, b, c*. The change of the reactance from $X_{L_1}$ to $X_{L_2}$ of the sensor inductor 1 under influence of a passing tyne is shown by FIG. 11*a* and is the same as that previously described with reference to FIG. 9*a*. The voltage appearing across the reference inductor 21 is supplied to the input of amplifier 59 and is shown by FIG. 11*b*. The voltage appearing across the sensor inductor 1 is supplied to amplifier 47 and is shown by FIG. 11*c*. The phase relationship of the voltage of FIG. 11*c* with respect to the voltage of FIG. 11*b* is shown by the figures to change from an out of phase relationship $\Delta\phi$ to an in phase condition and again to an out of phase relationship $\Delta\phi$ as the tyne respectively approaches, encloses, and leaves the sensor inductor 1. The value of the resistors 26, 28 and the reactances of the sensor inductor 1 and reference inductor 21 as well as the tyne material are selected as previously described to accentuate a maximum change of the phase $\Delta\phi$ such as shown in FIGS. 11*b*, 11*c*. Although the signal appearing across the sensor inductor 1 is shown in FIG. 11*c* as being constant in level or amplitude for the sake of clarity, it should be noted that this signal can change somewhat as a function of the change of the reactance $X_L$ of the sensor inductor 1.

In the FIG. 10 embodiment, the phase reference signal supplied to the demodulator 24 is provided by the output signal from the bridge 22 and appearing between terminal 32 and ground. This signal is supplied to the demodulator 22 by signal line 27. The reference signal can also be obtained directly from the carrier oscillator 23 or through a phase shift network if so desired in lieu of being obtained from the bridge 22. The bridge output signal developed across the sensor inductor 1 and appearing between the output terminal 31 and ground is supplied to an amplifier 47 and in turn supplied to the demodulator 24. The purpose of the amplifiers 47, 59 is to provide isolation between the bridge 22 output and the input to the demodulator 24. The amplifiers 47 and 59 can also be operated to provide amplitude clipping or limiting if so desired.

The output signal from the isolation amplifier 47 is supplied to a signal input transformer 48 of a synchronous phase detector 49. The phase reference signal from the isolation amplifier 59 is supplied to a reference phase signal input transformer 50 of the phase detector 49. The phase detector 49 comprised of signal diodes 51, 52, 53, and 54 and the respective input signal and phase reference signal transformers 48, 50 is a conventional ring configured detector which operates to provide a demodulated output signal at output terminals 55, 56. The phase reference signal appearing at the secondary winding 57 of transformer 50 provides alternate switching of the diode pairs 51, 52 and 53, 54 thereby causing a detected signal output from the secondary winding 58 of the signal transformer 48 to appear at the detector output terminals 55, 56. The level of the reference signal at the secondary winding 57 compared to the input signal level at the secondary winding 58 is on the order of 10:1 as is conventional in ring type detectors. The average output of the detector is at a maximum when the input signal at winding 58 is in phase with the reference signal at winding 57 and conversely, zero when the two signals are 90° out of phase. The phase demodulator 24 thus compares the phases of the two input signals and provides an output signal as a function thereof.

The output signal from the detector 49 is supplied to the input of a low pass filter 60. The operation of the low pass filter 60 suppresses any carrier signal originating from the carrier oscillator 23, and appearing at the output of the detector 49. The detected and filtered output signal from the low pass filter 60 is supplied to a Schmidt trigger 25 the operation of which was previously described in reference to FIG. 8. The output of the Schmidt trigger 25 is in turn supplied to output terminal 13 of the timing signal source. The waveform shown by FIGS. 11*d* and 11*e* are similar to those shown by the previously described FIGS. 9*d* and 9*e* in that they are the signal outputs of the respective demodulators 24 and Schmidt triggers 25. The waveform shown by FIG. 11*d* represents the output of the phase demodulator 24 of the FIG. 10 timing signal source 12.

Figure 12:
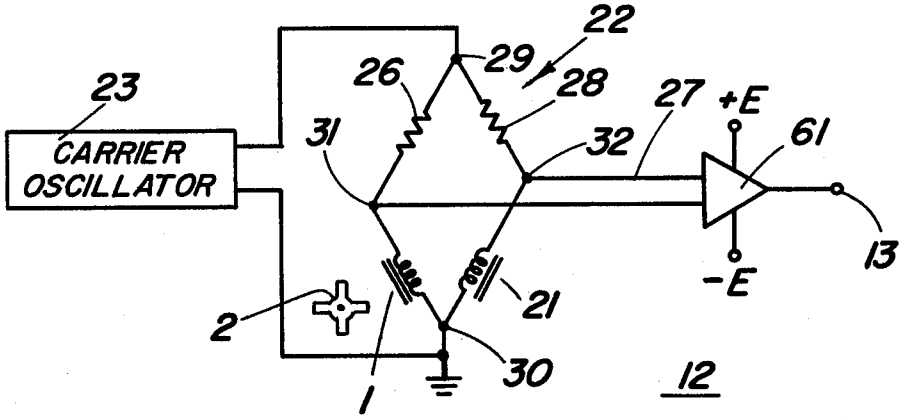
FIG. 12 shows a diagram of another embodiment of a timing signal source in accordance with the invention.

Referring to FIG. 12, there is shown another embodiment of the timing signal source 12 suitable for use in the breakerless ignition system of FIG. 7. It was discovered that a conventional operational amplifier when operated at relatively high signal input levels and at relatively high frequencies will operate to provide the functions provided by the isolation amplifiers 47, 59, the phase demodulator 24, the low pass filter 60, and the pulse shaper 25 of the timing signal source shown by FIG. 10. Therefore, in the FIG. 12 embodiment, much of the circuitry of the FIG. 10 embodiment can be replaced by a single integrated circuit type operational amplifier 61. Thus the operational amplifier 61 as shown in FIG. 12, replaces all of the circuitry shown in FIG. 10 which exists between the output terminals 31, 32 of the bridge 22 and the signal output terminal 13. The use of such an integrated circuit is highly desirable and of a distinct advantage since it results in a reduction of the manufacturing cost of the breakerless ignition system with an increase in the operational reliability of the system as is inherent with integrated circuits.

The operation and function of the carrier oscillator 23, bridge 22, sensor and reference inductors 1, 21 as well as the tyne assembly 2 shown in FIG. 12 has been previously described in relation to the FIG. 10 embodiment and is therefore not repeated. The output signal from the bridge 22 is supplied to the input terminals of operational amplifier 61. The signal output from the operational amplifier 61 is in turn supplied to the output terminal 13 of the timing signal source 12. In one embodiment constructed, a type 741C, manufactured by Fairchild Semiconductor, was used for the operational amplifier 61 shown in FIG. 12; however, other types of amplifiers can be used. The mode of operation of the operational amplifier 61 for providing the functions of phase detection and filtering and supplying the previously described timing output signal at terminal 13 is believed to be in accordance with the following description with reference to FIGS. 12 and 13.

Figure 13:
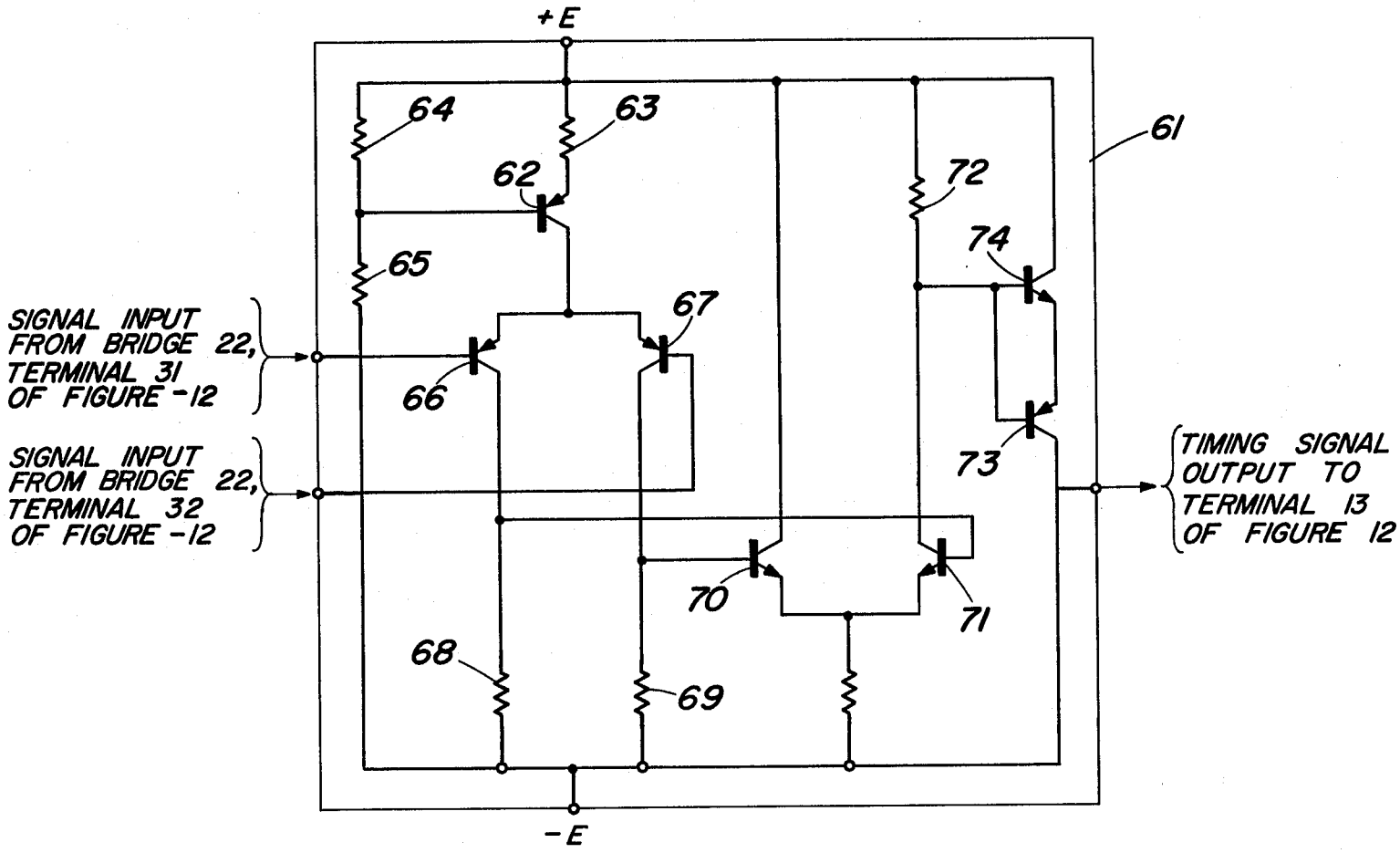
FIG. 13 shows a simplified diagram of an operational amplifier useful in the description of the FIG. 12 embodiment.

Referring to FIG. 13, there is shown a greatly simplified diagram of an operational amplifier representative in effect of a great many available types of operational amplifiers including the aforementioned type 741C.

Operational amplifiers such as the type 741 are normally utilized or operated with relatively low signal input levels and with signal frequencies well below the amplifier's maximum published characteristics and under such normal operation provide a normally desirable high degree of common mode rejection, i.e. identical signals applied to the two input terminals are prevented from appearing at the output terminal. The operational amplifier 61, as shown in FIG. 12, however, is operated with signal input levels at the input terminals on the order of 4 volts peak to peak and at the carrier signal frequency from the carrier oscillator 23 of 700 KHz. Under these conditions of operation, the amplifier 61 functions quite differently than would normally be expected or desired. Under this latter condition of operation in the timing signal source of FIG. 12, the operational amplifier 61 does not exhibit the normal common mode rejection characteristic but rather operates to provide a phase detection function for signals applied to its input terminals. The amplifier can, of course, be used in other applications where a similar phase detection and filtering function is desired and similar conditions of operation exist.

FIG. 13, as previously stated represents a simplified diagram of a common operational amplifier useful in explaining the operation of the amplifier 61 in the FIG. 12 embodiment. The transistor 62 and the associated resistors 63–65 function as a constant current source for transistors 66, 67. The transistors 66, 67 and associated collector load resistors 68, 69 normally function as a differential amplifier having a balanced output. The transistors 70, 71 normally function as a differential amplifier having an unbalanced output. Thus the differential amplifier comprising transistors 66, 67 normally supply a balanced input signal to the second differential amplifier comprised of transistors 70, 71. The unbalanced output of the latter differential amplifier developed across the output load resistor 72 is in turn supplied as an input signal to a pair of complementary connected transistors 73, 74 which function as a D.C. amplifier, the output of which is supplied to the output terminal of the operational amplifier 61.

In the present invention, the transistors 66 and 67 do not function as a differential amplifier but rather function as separate amplifiers for providing amplification of each separate one of the individual signals applied to the respective signal input terminals. Likewise, in the present invention, the transistors 70, 71 do not function as a differential amplifier but rather function as a phase detector and as such provide a demodulated signal to the signal output amplifier comprising transistors 73, 74.

In normal operation and use of an operational amplifier such as illustrated in FIG. 13, any common mode potential existing at the input signal terminals are rejected from appearing at the output terminal. This rejection ratio can be, for example, on the order of 30,000 to 1 or 90 db and results from the fact that under normal conditions, the constant current source comprised of transistors 62 and associated resistors 63–65 exhibits a very high dynamic impedance and the fact that the two branches of the differential amplifier comprising transistors 66 and 67 are highly matched. Under these normal conditions, the output is mainly a function of an amplified version of the difference of the potentials existing on the input terminals 2 and 3.

In the immediate application of the operational amplifier 61, such as in the FIG. 12 embodiment of the ignition timing signal source, the above described normal operation does not however take place. The published voltage gain of, for example, the 741 operational amplifier is unity at an operating frequency of 1 MHz and at 700 KHz is only slightly greater. With operation of the operational amplifier 61 at the 700 KHz carrier frequency, the constant current source comprised of the transistor 62 and associated circuitry does not exhibit the aforementioned normal high impedance where the current in the emitters of the transistors 66 and 67 can be exchanged for deriving and providing differential effects. This change from normal operation is believed to be caused by the frequency response limitations due to, for example, distributed capacity and charge storage effects of the operational amplifier circuitry. The current from the emitters of transistors 66 and 67 are not equally exchanged and hence the normal common mode rejection ratio is greatly reduced. The signals supplied to the inputs of the succeeding differential amplifier comprising transistors 70 and 71 are now in the immediate application of such a level that the latter transistors 70, 71 can be driven into a non-linear switching like region of operation in lieu of being operated as the normally intended differential amplifier. Thus the transistors 70 and 71 operate as a synchronous or switching like phase demodulator. This demodulator function or operation can also be considered somewhat similar to the operation of an AND gate where an output signal is provided for coinciding input signals, thus the average value of the resultant output signal from the demodulator is a function of the phase relationship of the two separate input signals. Operation of the operational amplifier 61 at frequencies in excess of those normally intended provide a filtering and averaging effect of the output signals. Thus, a conventional operational amplifier 61 can be used in the FIG. 12 timing signal source to provide the desired phase demodulation, filtering, amplification and signal shaping functions.

It will now be apparent to one skilled in the art that the bridge circuit in effect functions as a comparator as well as a modulator and that the values of resistance of each one of the bridge resistors 26 and 28 as well as the values of reactance or impedance of the sensor inductor 1 and of the reference inductor 21 can be of any desired combination to provide a balanced condition of the bridge and/or any desired phase relationship of the bridge output signals for any given positional relationship between the sensor inductor 1 and the individual tynes of the tyne assembly 2. As one example, the aforementioned resistance and reactance values can be selected to provide a minimum signal output between the bridge output terminals 31 and 32 or an output signal between the terminals 31 and 30 which is in phase with the signal between terminals 32 and 30 when the sensor inductor 1 is just entering and leaving the tyne rather than when, for example, the sensor inductor 1 is fully enclosed or affected by the tyne. As another example, the reactance of the sensor inductor 1 can be made part of a series or parallel resonant circuit of the bridge thereby providing both a leading and lagging phase condition as the circuit is caused to pass through a resonant frequency as a result of a predetermined affect of the tyne upon the sensor reactance. Likewise, the resistors 26, 28 can be replaced by reactances, capacitive or inductive and the reference inductor can be replaced by a resistance or a capacitive reactance.

It will now be appreciated that we have provided a new and novel breakerless ignition system having a timing signal source for generating a timing signal which is not a function of engine speed. The ignition system is essentially not sensitive to changes in temperature due to the use of the bridge and reference inductance. As mentioned hereinbefore, the reference inductance is located as near as possible to the sensor so that both inductors are exposed to the same temperature. There are no appreciable delays caused by our ignition system from the time of a change of position of the engine to generation of the H.V. spark. High or low speeds of the internal combustion engine do not affect response time of the ignition system. However, in addition to providing a new and improved breakerless ignition system we have also provided a scheme that is readily adaptable to being used as a tachometer or as a positional indication of an object with advantages similar to those achieved for the ignition system. A moving object or a rotating shaft can have a tyne or knob or a slight gap such as a void of material that causes a change of inductance of a sensor and the change of inductance can be processed as set out hereinbefore to generate an output signal. The output signal can be used as a tachometer input or as a positional indication depending upon the desired application.

Consequently, while in accordance with the Patent Statutes, we have described what at present are considered to be the preferred forms of our invention it will be obvious to those skilled in the art that numerous changes and modifications may be made herein without departing from the spirit and scope of the invention, and it is therefore aimed in the following claims to cover all such modifications.

What is claimed is:

1. A timing signal source for an internal combustion engine, comprising:

a rotatable means having at least one tyne of a ferromagnetic material and adapted to be coupled to the engine for providing a relative angular rotation therewith;

a sensor means including an inductor mounted in close proximity to said rotatable means and having an impedance which varies as a function of the relative angular position between the sensor means and the tyne of said rotatable means for providing a predetermined sensor property at a predetermined rotational position of the engine;

a reference means including an inductor for providing a predetermined impedance;

a signal generating means having output terminals for providing a constant frequency carrier signal;

a bridge network means having at least first and second parallelled signal branches connected to the output terminals of said signal generating means and having said sensor means connected in the first branch and said reference means connected in the second branch for providing a predetermined relationship of signal currents in the first and second branches at said predetermined rotational position of the engine; and a detector means connected to said bridge means for detecting said predetermined relationship of signal currents in the first and second branches and for providing in response thereto an output signal indicative of said predetermined rotational position of the engine.

2. A timing signal source for an internal combustion engine, comprising:

a rotatable means having at least one tyne of an electrically conductive non-magnetic material and adapted to be coupled to the engine for providing a relative angular rotation therewith;

a sensor means including an inductor mounted in close proximity to said rotatable means and having an impedance which varies as a function of the relative angular position between the sensor means and the tyne of said rotatable means for providing a predetermined sensor property at a predetermined rotational position of the engine;

a reference means including an inductor for providing a predetermined impedance;

a signal generating means having output terminals for providing a constant frequency carrier signal;

a bridge network means having at least first and second parallelled signal branches connected to the output terminals of said signal generating means and having said sensor means connected in the first branch and said reference means connected in the second branch for providing a predetermined relationship of signal currents in the first and second branches at said predetermined rotational position of the engine; and a detector means connected to said bridge means for detecting said predetermined relationship of signal currents in the first and second branches and for providing in response thereto an output signal indicative of said predetermined rotational position of the engine.

3. A timing signal source for an internal combustion engine, comprising:

a rotatable means having at least one tyne thereon and adapted to be coupled to the engine for providing a relative angular rotation therewith;

a sensor means mounted in close proximity to said rotatable means and having an electrical property which varies as a function of the relative angular position between the sensor means and the tyne of said rotatable means for providing a predetermined sensor property at a predetermined rotational position of the engine;

a reference means for providing a predetermined electrical property;

a signal generating means having output terminals for providing a constant frequency carrier signal;

a bridge network means having at least first and second parallelled signal branches connected to the output terminals of said signal generating means and having said sensor means connected in the first branch and said reference means connected in the second branch for providing a predetermined amplitude relationship of signal currents in the first and second branches at said predetermined rotational position of the engine; and demodulator means connected to said bridge means for demodulating said predetermined amplitude relationship of signal currents in the first and second branches and for providing in response thereto an output signal indicative of said predetermined rotational position of the engine.

4. A timing signal source for an internal combustion engine, comprising:

a rotatable means having at least one tyne thereon and adapted to be coupled to the engine for providing a relative angular rotation therewith;

a sensor means mounted in close proximity to said rotatable means and having an electrical property which varies as a function of the relative angular position between the sensor means and the tyne of said rotatable means for providing a predetermined sensor property at a predetermined rotational position of the engine;

a reference means for providing a predetermined electrical property;

a signal generating means having output terminals for providing a constant frequency carrier signal;

a bridge network means having at least first and second parallelled signal branches connected to the output terminals of said signal generating means and having said sensor means connected in the first branch and said reference means connected in the second branch for providing a predetermined phase relationship of signal currents in the first and second branches at said predetermined rotational position of the engine; and demodulator means connected to said bridge means for demodulating said predetermined phase relationship of signal currents in the first and second branches and for providing in response thereto an output signal indicative of said predetermined rotational position of the engine.

5. The timing signal source of claim 4 wherein said phase demodulator means consists of an operational amplifier having a loop feedback for providing a voltage gain substantially that of the open loop voltage gain capability of the operational amplifier and having at said carrier frequency of signal generating means a voltage gain substantially that of unity gain.

* * * * *